US007038121B2

(12) United States Patent
Ishiwaka et al.

(10) Patent No.: US 7,038,121 B2
(45) Date of Patent: May 2, 2006

(54) CONTENTS REPRODUCTION SYSTEM AND PROCESS

(75) Inventors: Takuo Ishiwaka, Yokohama (JP); Toru Takagi, Yokohama (JP); Koichi Kuroda, Yokohama (JP); Susumu Fujita, Yokohama (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 235 days.

(21) Appl. No.: 10/338,639

(22) Filed: Jan. 9, 2003

(65) Prior Publication Data

US 2003/0126974 A1 Jul. 10, 2003

(30) Foreign Application Priority Data

Jan. 10, 2002 (JP) ..... 2002-003804

(51) Int. Cl.
*G10H 7/00* (2006.01)
*G10H 1/18* (2006.01)

(52) U.S. Cl. ..... 84/615; 84/609

(58) Field of Classification Search ..... 84/600, 84/609, 615

See application file for complete search history.

(56) References Cited

U.S. PATENT DOCUMENTS 6,564,003 B1 * 5/2003 Marko et al. ..... 386/69

FOREIGN PATENT DOCUMENTS

JP P2000-261731 A 9/2000

* cited by examiner

*Primary Examiner*—Jeffrey W Donels
(74) *Attorney, Agent, or Firm*—McDermott Will & Emery LLP

(57) ABSTRACT

A contents reproduction system includes a reproducing section to reproduce a content received via telecommunication when the receiving condition is in an acceptable state, and to reproduce one of recorded contents stored in a storage section when the receiving condition is in an unacceptable state. A preference discriminating section determines a preference of a user by examining at least one content selected by a user for reproduction. A contents selecting section selects one, as a reserve content, from the contents stored in the storage section in accordance with the preference and supplies the reserve content to the reproducing section for reproduction instead of the received content when the receiving condition is in the unacceptable state.

12 Claims, 9 Drawing Sheets

CONTENTS REPRODUCTION SYSTEM AND PROCESS

BACKGROUND OF THE INVENTION

The present invention relates to techniques for receiving and reproducing content such as sounds and video images, and more specifically to a contents reproduction system or process to be mounted or performed on a movable body such as a vehicle.

Published Japanese Patent Application Kokai No. 2000-261731 discloses a source changeover device arranged to change over the source of data for reproduction, from broadcast signals to a storage medium, such as a CD, when the reception state is poor as in a weak electric field strength region, e.g., a mountainous region.

SUMMARY OF THE INVENTION

The changeover of contents can cause a sense of discomfort when the content is changed abruptly.

It is therefore an object of the present invention to provide a contents reproduction system and/or process adapted to achieve a changeover of contents smoothly.

According to the present invention, a contents reproduction system comprises: a receiving section to receive contents transmitted from a spatially separated place; a storage section to store contents to be reproduced; a monitoring section to monitor a receiving condition indicative of a reception state of a content received by the receiving section; a reproducing section to reproduce a received content received by the receiving section when the receiving condition is in a predetermined acceptable state, and to reproduce one of contents stored in the storage section when the receiving condition is in an unacceptable state; a preference discriminating section to examine at least one content selected by a user for reproduction, and determine a preference of the user; and a contents selecting section to select one, as a reserve content, from the contents stored in the storage section in accordance with the preference determined by the discriminating section, and to supply the reserve content to the reproducing section for reproduction instead of the received content when the receiving condition is in the unacceptable state.

According to another aspect of the present invention, a contents reproduction system comprises: means for receiving contents; means for storing contents; means for monitoring a receiving condition indicative of a reception state of data received by the receiving means; means for reproducing a received content received by the receiving means when the receiving condition is in a predetermined acceptable state, and to reproduce one of contents stored in the storage means when the receiving condition is in an unacceptable state; means for examining at least one content selected by a user for reproduction, and determining a preference of the user; and means for selecting one content, as a reserve content, from the contents stored in the storing means in accordance with the preference, and for supplying the reserve content to the reproducing means when the receiving condition is in the unacceptable state.

According to still another aspect of the present invention, a contents reproduction process comprises: a first process element of receiving a received content transmitted from a spatially separated place; a second process element of determining a preference of a user by examining a content selected by the user; a third process element of selecting, as a reserve content, one from contents stored in a storage medium; a fourth process element of examining whether a receiving condition indicative of a reception state of data of the received content is in a predetermined acceptable state; and a fifth process element of reproducing the received content when the receiving condition is in the acceptable state, and reproducing the reserve content when the receiving condition is not in the acceptable state.

The other objects and features of this invention will become understood from the following description with reference to the accompanying drawings.

DETAILED DESCRIPTION OF THE INVENTION

Figure 1:
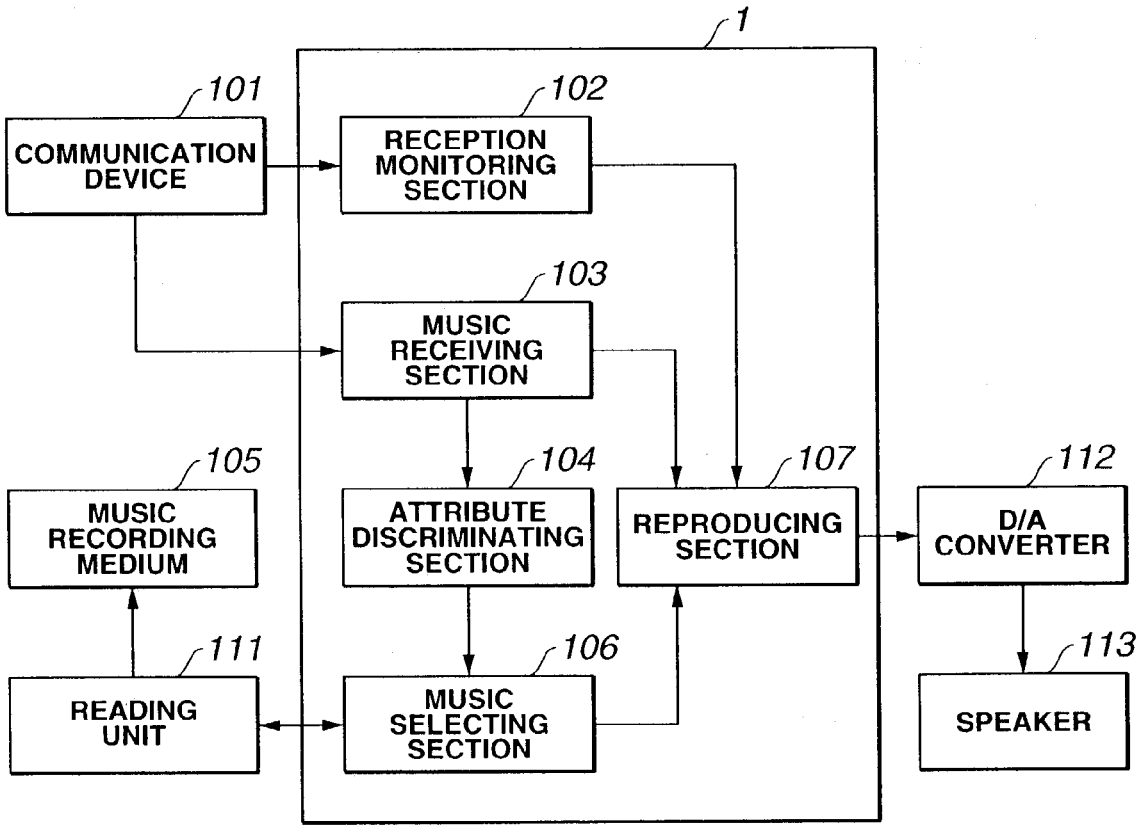
FIG. 1 is a block diagram showing a contents reproduction system according to a first embodiment of the present invention.

FIG. 1 shows, in a block diagram, a contents reproduction system according to a first embodiment of the present invention. The reproduction system of this example is a system designed to receive and reproduce music specifically. The reproduction system of the example shown in FIG. 1 includes: a control unit 1 including a reception monitoring section 102, a music receiving section (or content receiving section) 103, an attribute discriminating (or checking) section 104 serving as a user's preference discriminating section, a music selecting section (or contents selecting section) 106, and a reproducing section (or contents reproducing section) 107; a communication device or unit 101, a music storage medium 105; a reading device or unit 111; a D/A converter 112; and a speaker 113.

Contents to be received and reproduced by this reproduction system may be sounds, motion pictures of various kinds or other contents that vary with time.

Communication device 101 of this embodiment is a device capable of data communication, such as a mobile phone or cellular phone. Alternatively, communication device 101 may be a radio receiver for receiving broadcasts. A function of communication device 101 is to deliver information on a reception state, such as information on received signal strength, and information on noise level in the received signal. The reception information on the reception state is supplied to reception monitoring section 102, and received music data is delivered to music receiving section 103. The reception state can differ from place to place due to changes in the strength of radio waves. Moreover, the reception state can be affected by the condition of a server on the sender's side (the load of the server, etc.).

Music receiving section 103 communicates with a server on the Internet through communication unit 101, and obtains music data by downloading. Preferably, attribute data such as data on artist name and genre is added to music data to be downloaded.

Attribute discriminating section 104 extracts the attributes of music downloaded by music receiving section 103. When the downloaded music has no attribute data, attribute discriminating section 104 of this example extracts attributes in accordance with various features of music such as the tempo and rhythm of music, and the register (or range) of a singer's voice. The thus-extracted attribute data is delivered to music selecting section 106.

Reception monitoring section 102 receives the reception data on the reception state from communication unit 101, and judges whether the reception (state) is adequate (or acceptable) or not. The result of the judgment is delivered to reproducing section 107, and used as data for determining which to select, the received music or the stored or recorded music stored in music recording medium 105.

Music recording medium 105 of this example is a storage device having a large storage capacity, such as a hard disk. Music recording medium 105 of this example stores music data together with attribute data. Music storage medium 105 is set in such a position that reading unit 111 such as a hard disk drive can read data from music recording medium 105. Music recording medium 105 may be a compact disk for storing music data together with attribute data. In this case, reading unit 111 is a compact disk drive. Reading unit 111 can serve as a storage section to store contents to be reproduced together with music recording medium 105.

Music selecting section 106 is connected with reading unit 111, to access data in music recording medium 105, and configured to select content from the music data stored in music recording medium 105. Music selecting section 106 selects content in accordance with the output of attribute discriminating section 104 so that the selected music has similar attributes to the music currently being received by music receiving section 103. The result of the selection is delivered to reproducing section 107.

First, reproducing section 107 performs the function of determining which to reproduce, the output of music receiving section 103 or music in music recording medium 105, in dependence on the output of music selecting section 106. The reproduction of the output of music receiving section 103 is selected when the output signal of reception monitoring section 102 indicates that the reception is in an adequate or acceptable state. The reproduction of music read out by reading unit 111 from the music recording medium 105 is selected when the output signal of reception monitoring section 102 indicates that the reception is in an inadequate or unacceptable state.

Second, reproducing section 107 performs the function of reproducing the selected music by outputting the music data to D/A converter 112. D/A converter 112 converts music data into analog form, and speaker system 113 receives electric signals amplified by an amplifier (not shown), and converts the electric signals to audible sound.

Figure 2:
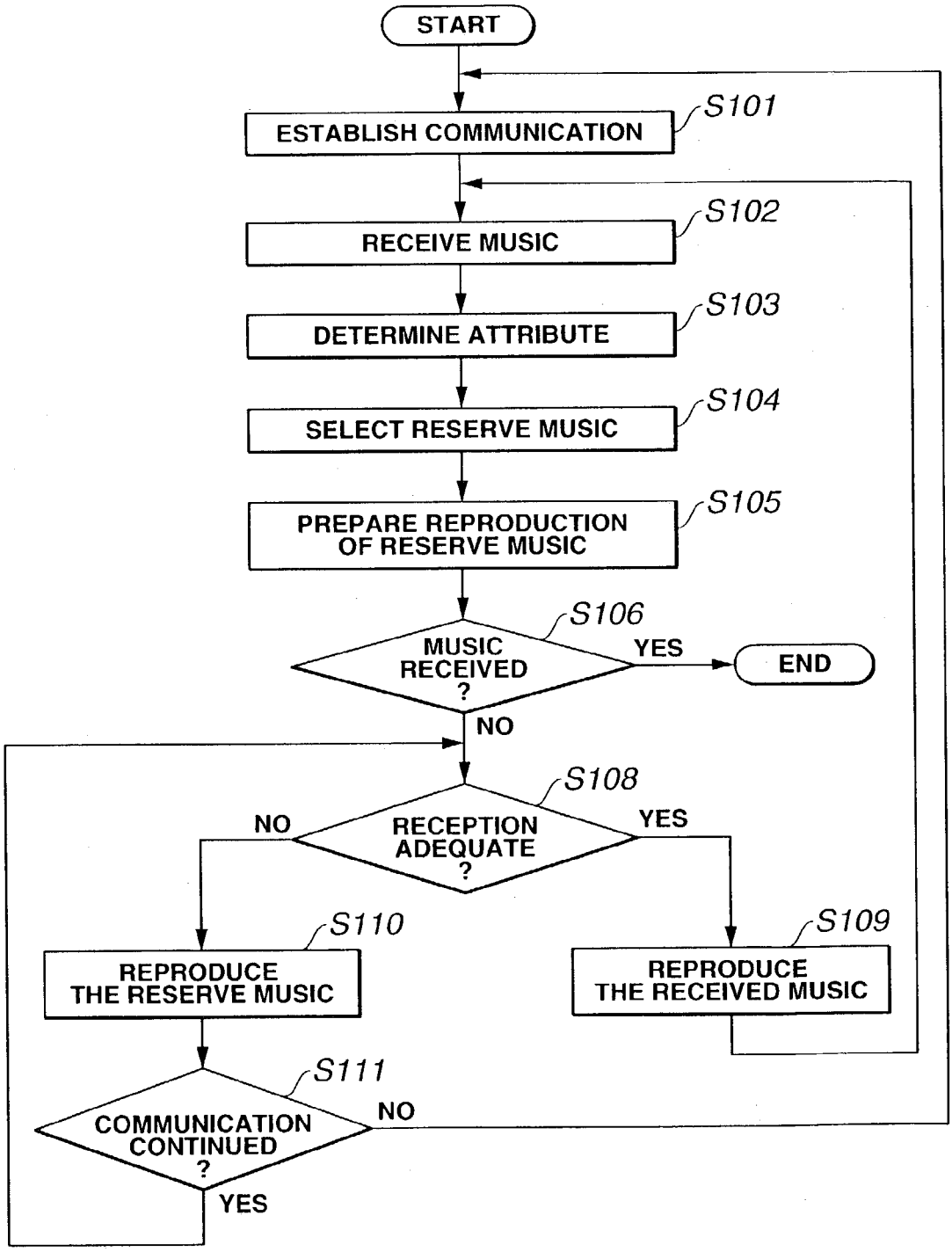
FIG. 2 is a flowchart showing a contents reproduction process performed by the system of FIG. 1.

FIG. 2 is a flowchart showing a contents reproduction process according to the first embodiment.

At step S101, the contents reproduction system establishes a communication link by using communication device 101 which in this example is a mobile phone (cell phone). When the communication device 101 is a radio receiver, a program is selected by receiving broadcast radio waves at a prescribed frequency. At step S102, the system starts receiving music with music receiving section 103 through communication device 101.

At step S103, control unit 1 extracts an attribute of the received music currently being received, by using attribute discriminating section 104. At step S104, control unit 1 selects music whose attribute is similar to the attribute of the received music, from the music source stored in music recording medium 105. When, for example, there is stored, in music recording medium 105, music performed by the artist of the music currently being received, then music selecting section 106 selects that music of the same artist. When there is stored, in music recording medium 105, no music of the same artist, then music selecting section 106 selects music from the genre to which the artist of the music currently being received mainly belongs. The thus-selected music is treated as reserve music.

At step S105, control unit 1 prepares for reproduction of the reserve music determined at step S104, with reproducing section 107. At step S106, control unit 1 examines whether the reception of the music is completed or not. If it is not, control unit 1 proceeds to step S108.

At step S108, control unit 1 checks the reception state with reception monitoring section 102. In this example, reception monitoring section 102 evaluates the reception state by the strength of the signal received by communication device 101. When the strength of the received signal is higher than a predetermined threshold strength level, control unit 1 considers that the reception state is adequate or acceptable, and proceeds to step S109 to reproduce the music being currently received with reproducing section 107. After step S109, control unit 1 returns to step S102. Thus, control unit 1 continues the reception and reproduction of the music until the reception of the music is finished and the answer of step S106 becomes YES.

When the strength of the signal received by communication device 101 is lower than or equal to the predetermined threshold strength level, and hence the reception state is considered to be inadequate or unacceptable, then control unit 1 proceeds from step S108 to step S110, and reproduces the reserve music selected at step S104, with reproducing section 107, instead of the received music.

At step S111, control unit 1 examines whether the communication link is in a disconnected state or not. When the communication link is maintained and the communication is ongoing, then control unit 1 returns from step S111 to step S108. Therefore, the reproduction of the reserve music is continued until the reception state becomes adequate. If the communication link is disconnected, and the communication is not continuable, then control unit 1 proceeds from step S111 to step S101, to reestablish the communication link. In this case, too, the reproduction of the reserve music is continued until the communication is reestablished (at step S101) and the reception state becomes adequate (the answer of step S108 becomes affirmative).

The threshold strength level of the signal strength for changeover from the received music to the reserve music is not necessarily equal to the threshold strength level for changeover from the reserve music to the received music.

The contents reproduction system according to the first embodiment is arranged to change information source by selecting from contents in the storage medium in accordance with the attribute of the received content if the reception state becomes poor. Accordingly, the contents reproduction system can continue the contents reproduction by changing the information source without causing unnatural feeling to a user.

Figure 3:
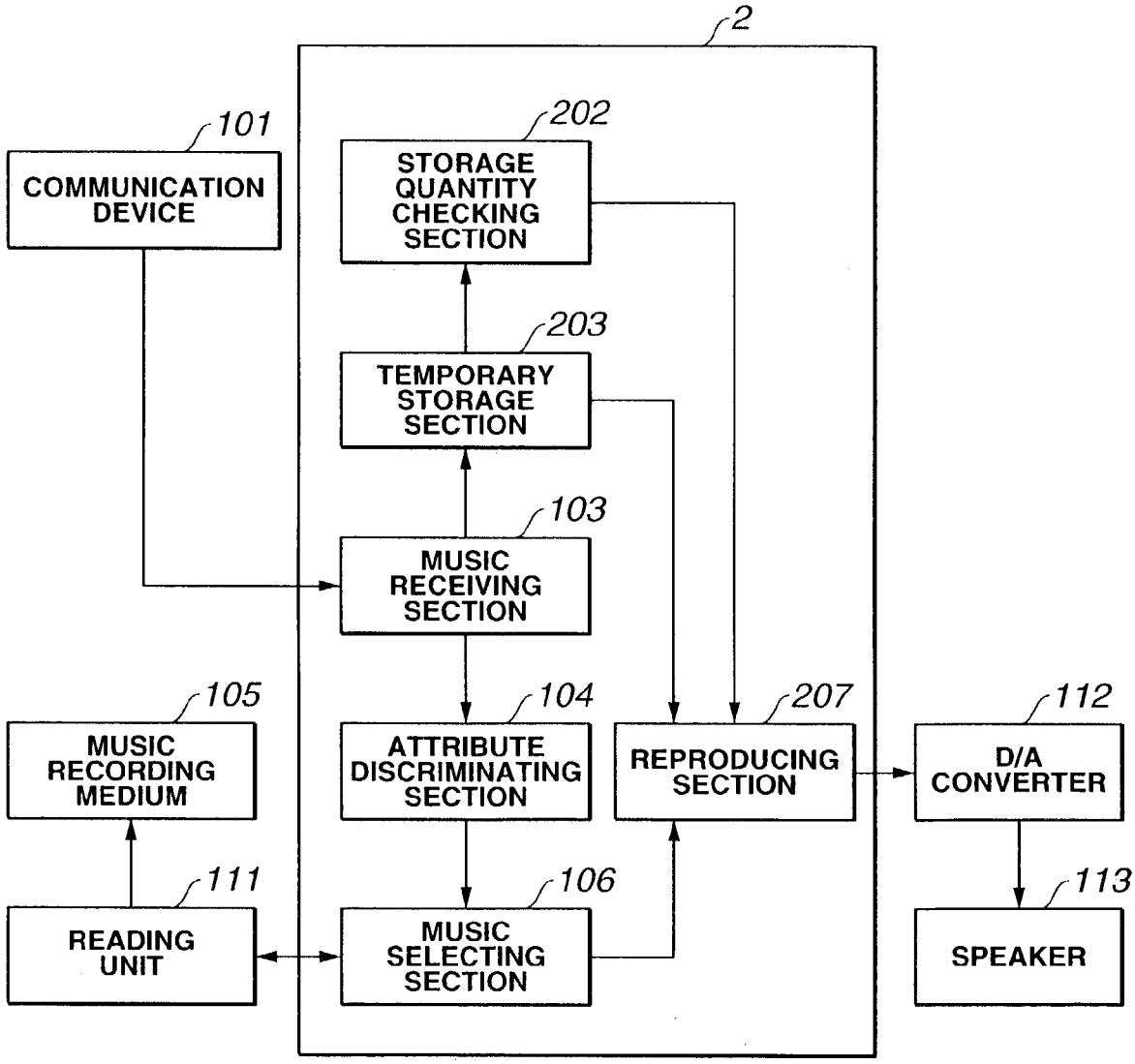
FIG. 3 is a block diagram showing a contents reproduction system according to a second embodiment of the present invention.

FIG. 3 shows a contents reproduction system according to a second embodiment. The same reference numerals are given to parts substantially identical to the first embodiment, and repetitive detailed explanation is omitted. A control unit 2 according to the second embodiment is configured to reproduce music while receiving music data and temporarily storing (buffering) the data.

As shown in FIG. 3, control unit 2 according to the second embodiment includes a storage quantity checking or monitoring section 202, a temporary storage section 203 and a reproducing section 207 in addition to music receiving section 103, attribute discriminating section 104, and music selecting section 106.

Temporary storage section 203 is a section for temporarily storing music received by music receiving section 103. Temporary storage section 203 delivers data downloaded by music receiving section 103, to reproducing section 207 while temporarily storing the data.

Storage quantity checking or monitoring section 202 monitors the quantity of data temporarily stored in temporary storage section 203, and examines whether the temporary storage quantity is greater than a predetermined threshold quantity level or not. The result of the examination is supplied to reproducing section 207.

Reproducing section 207 determines which to reproduce, the output of temporary storage section 203 or music readable by reading unit 111 in accordance with the output of music selecting section 106; and reproduces the music selected in this way. In this example, reproducing section 207 reproduces the music data outputted from temporary storage section 203 when the storage quantity is judged to be greater than the predetermined threshold quantity level, by storage quantity checking section 202. When the storage quantity of data temporarily stored in temporary storage section 203 is judged to be less than or equal to the predetermined threshold quantity level, then reproducing section 207 reproduces the music data read by reading unit 111 in accordance with the output signal of music selecting section 106.

Figure 4:
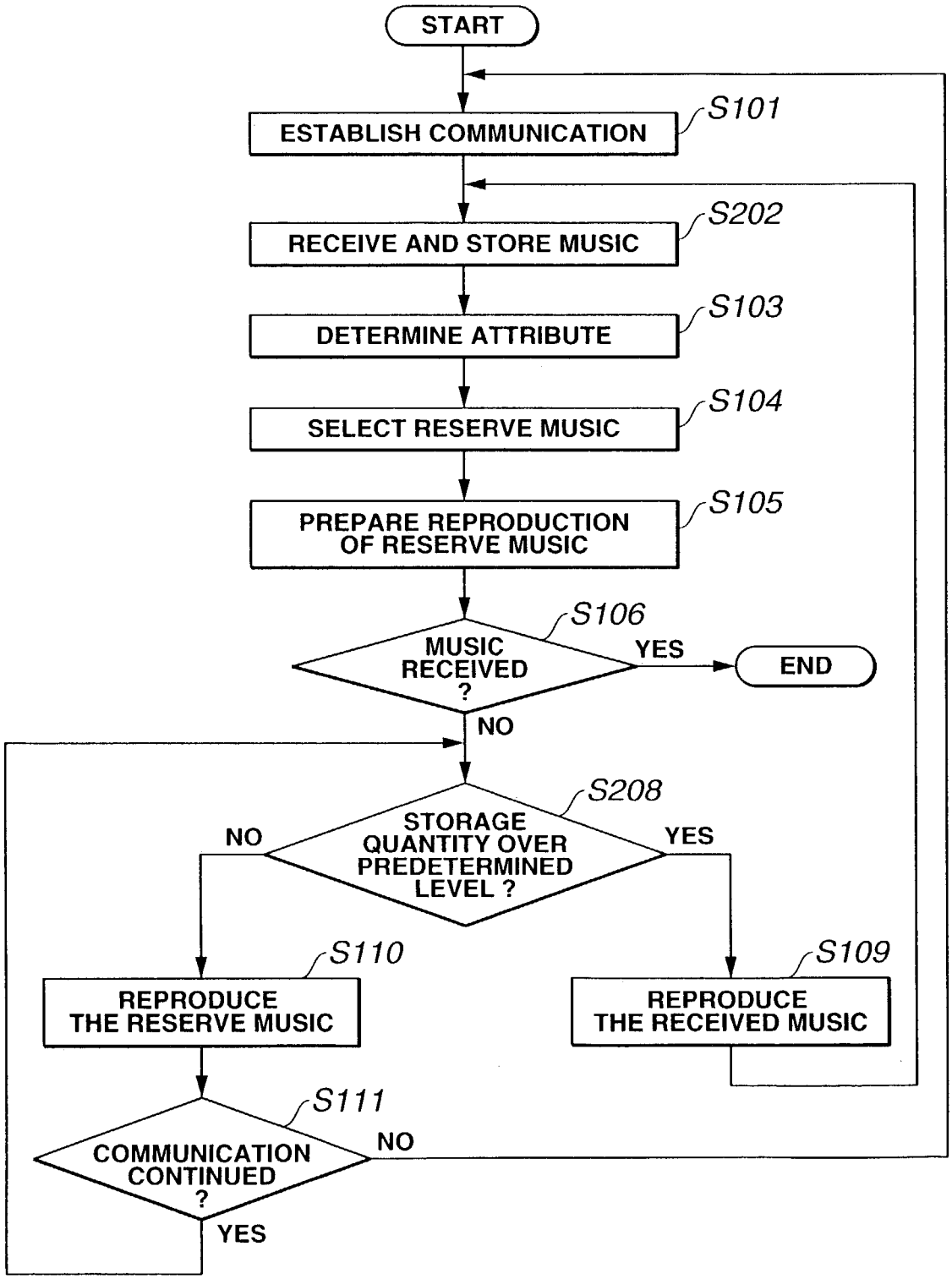
FIG. 4 is a flowchart showing a contents reproduction process performed by the system of FIG. 3.

FIG. 4 is a flowchart showing a contents reproduction process according to the second embodiment. The same step numbers are given to steps substantially identical to corresponding steps shown in FIG. 2.

At step S101, the contents reproduction system establishes communication and receives music. When receiving music, the reproduction system stores the received music data temporarily in temporary storage section 203 at step S202. In this example, temporary storage section 203 stores data corresponding to a reproducing time of 3~4 seconds, and delivers data successively after the elapse of this temporary storage time, to reproducing section 207.

Then, as in the first embodiment, control unit 3, checks the attribute of the received music currently being received, at step S103; determines the reserve music at step S104; and prepares for the reproduction of the reserve music at step S105. When the reception of the music is finished (step S106), control unit 3 reproduces the temporarily stored data not yet reproduced, and ends the process. When the reception of the music is not yet finished, control unit 2 proceeds from step S106 to step S208.

At step S208, control unit 1 examines whether the data storage quantity is greater than the predetermined threshold quantity level or not, by using storage quantity checking section 202 of control unit 2. When the storage quantity is greater than the predetermined threshold quantity level, then control unit 2 proceeds from step S208 to step S109, and reproduces the data stored in temporary storage section 203 and subjected to buffering. Thus, the reproduction system according to the second embodiment can continue the stable reproduction even if the reception state changes. When the storage quantity is smaller than or equal to the threshold quantity level, then control unit 2 proceeds from step S208 to step S110, and reproduces the reserve music selected at step S104, with reproducing section 107, instead of the received music. When the storage quantity is smaller than or equal to the threshold quantity level, it is likely that the reproduction of the received music will be interrupted even by transient instability of the communication. In this case, therefore, control unit 2 of the second embodiment changes over the reproduction from the received music to the reserve music. Thus, control unit 2 continues the reproduction of the reserve music and at the same time continues the storage of the received music until the storage quantity for buffering becomes greater than the predetermined threshold quantity level.

The threshold quantity level of the storage quantity for changeover from the received music to the reserve music is not necessarily equal to the threshold quantity level for changeover from the reserve music to the received music. When, for example, the output value of storage quantity checking section 202 at the time of changeover from the received music to the reserve music is a first predetermined value, and the output value of storage quantity checking section 202 at the time of changeover from the reserve music to the received music is a second predetermined value, the first predetermined value may be set smaller than the second predetermined value.

The contents reproduction system according to the second embodiment is arranged to reproduce received data while temporarily storing (buffering) the received data, and to change the information source by selecting the contents in accordance with the result of discrimination of the attribute if the data storage quantity becomes insufficient. Accordingly, the contents reproduction system can continue the contents reproduction by changing the information source without causing unnatural feeling to a user even if the reception state becomes poor and the storage speed cannot catch up with the reproduction speed.

Figure 5:
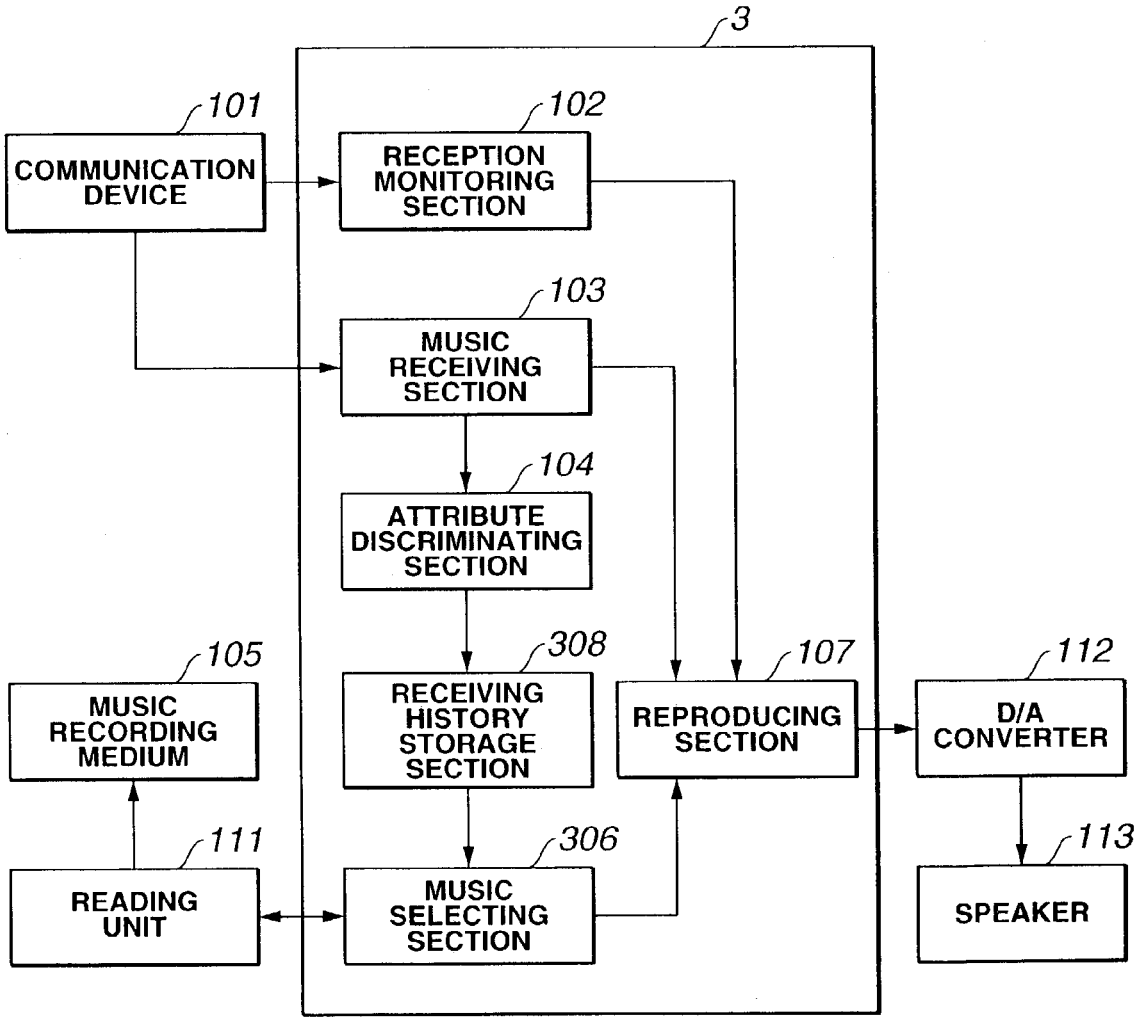
FIG. 5 is a block diagram showing a contents reproduction system according to a third embodiment of the present invention.

FIG. 5 shows a contents reproduction system according to a third embodiment of the present invention. A control unit 3 according to the third embodiment records a history of reception of music, and selects music as the reserve music in accordance with the receiving history.

A receiving history storage or recording section 308 records a history of access in music receiving section 103. This history may contain information specifying music, such as music titles. Preferable attribute information items used for the access history are artist name, genre, and age (period). Furthermore, the history information may contain data as to whether a user has listened to a piece of music to the end or quit halfway. In this case, control unit 3 reflects this data on the selection of the reserve music.

Music selecting section 306 selects music to be used as the reserve music in accordance with the access history or receiving history recorded in receiving history storage section 308 so that the attribute of the selected music is high in frequency of selection by the user. Thus, the contents reproduction system can select a piece of music adequately in conformity with the taste of the user, from music stored in music recording medium 105. For example, selection is made from the genre which has been selected by the user most frequently, and from pieces of the artist which has been selected by the user most frequently.

Figure 6:
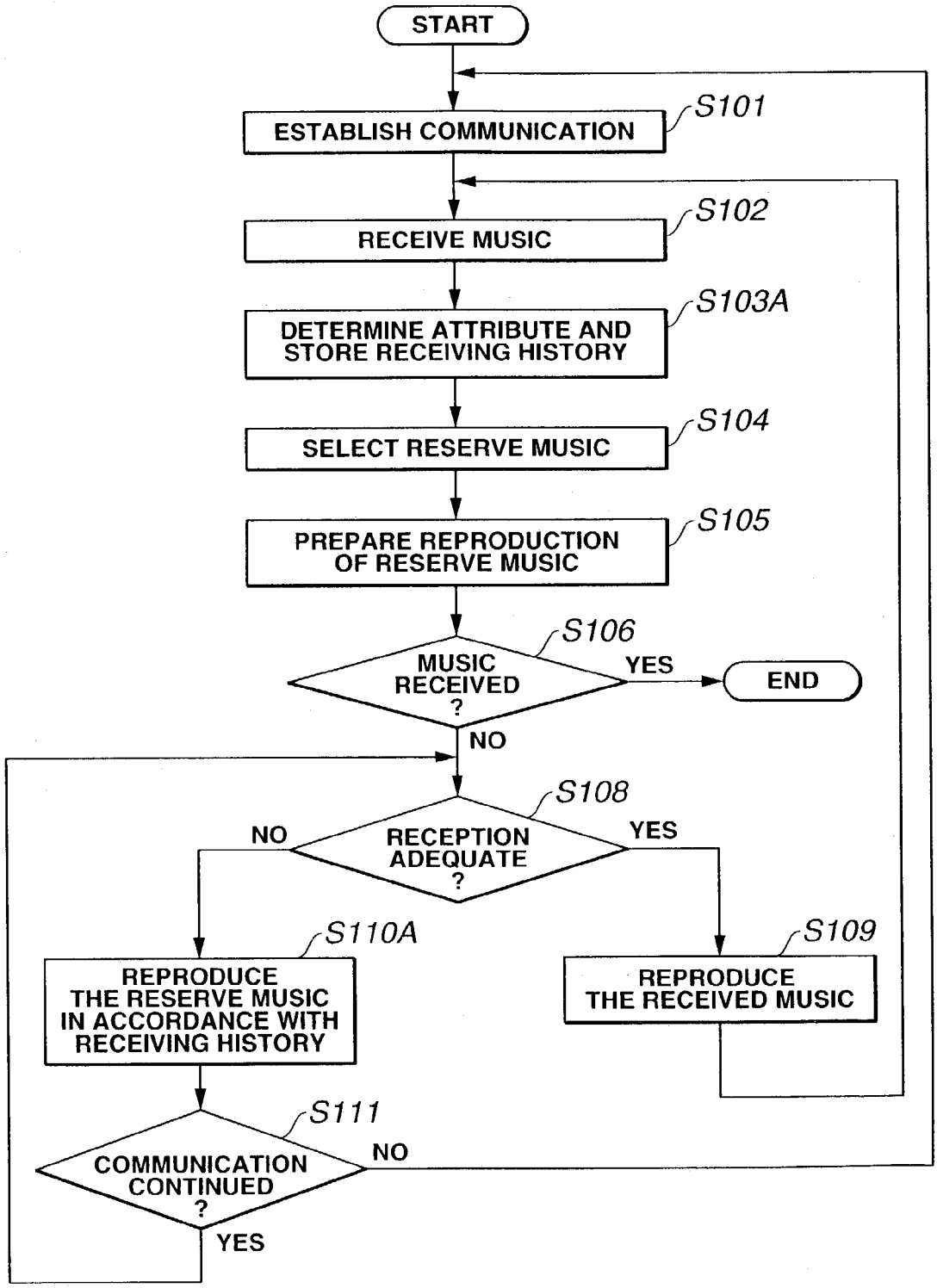
FIG. 6 is a flowchart showing a contents reproduction process performed by the system of FIG. 5.

FIG. 6 is a flowchart showing a contents reproduction process according to the third embodiment. Steps substantially identical to corresponding steps in FIG. 2 are given the same reference numerals. At step S103A following step S102, control unit 3 prepares a receiving history list by discriminating attributes of received music, and stores the receiving history list in receiving history storage section 308. The receiving history list is prepared in accordance with the attributes of received music. For example, the receiving history list includes a reception frequency list of each artist and/or of each genre.

When the reception state is not adequate, control unit 3 proceeds from step S108 to step S110A, and reproduces the reserve music selected in accordance with the receiving history list recorded in receiving history storage section 308. In the receiving history list of each attribute, pieces of music are arranged in accordance with the frequency of reception by the user. Therefore, control unit 3 can select and reproduce music of the highest reception frequency among music pieces stored in music storage medium 105.

The contents reproduction system according to the third embodiment is arranged to preferentially select contents having the attribute frequently selected by the user. Therefore, music is selected more adequately in conformity with the taste of the user.

Figure 7:
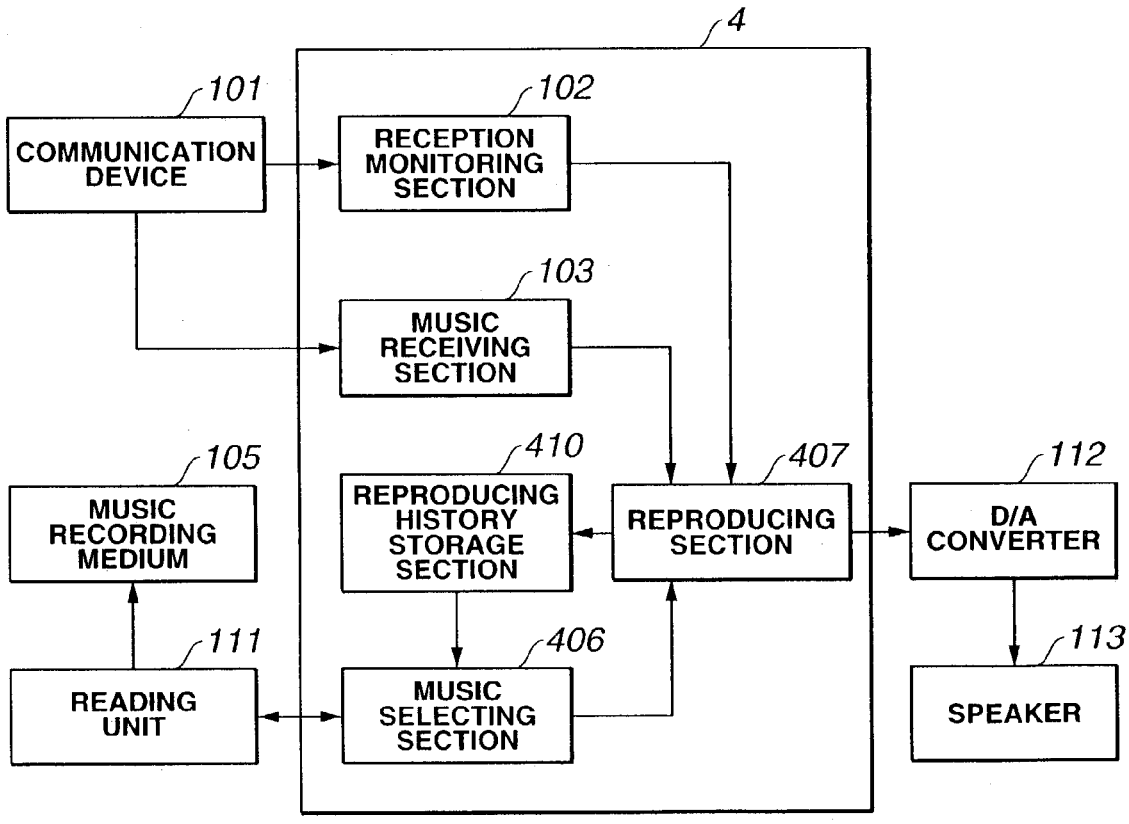
FIG. 7 is a block diagram showing a contents reproduction system according to a fourth embodiment of the present invention.

FIG. 7 shows a contents reproduction system according to a fourth embodiment of the present invention. Parts similar to corresponding parts in the first embodiment are given the same reference numerals and repetitive explanation is omitted. A control unit 4 according to the fourth embodiment records a history of reproduction of music read out from music storage medium 105, and selects music as the reserve music in accordance with the reproducing history.

A reproducing section 407 has the function of selecting one from the received music and the reserve music, and the function of reproducing the selected music, as in the first embodiment. Moreover, reproducing section 407 forms a car audio system in conjunction with music recording medium 105. Reproducing section 407 can select music from the collection in music storage section 105 in accordance with operations on buttons of the audio system by the user, and reproduce the music thus selected directly by the user from the collection in music recording medium 105.

A reproducing history storage or recording section 410 records a history of music reproduced by the audio system under the control of the user, in the form of a reproduction history list. This history may contain information specifying each piece of contents, such as music titles, disk numbers or track numbers. The reproduction history list is prepared in accordance with the attributes of music reproduced. In this example, there are prepared a reproduction history list prepared by the artist name and a reproduction history list prepared by the genre. Furthermore, the history information may contain data as to whether a user has listened to a piece of music to the end or quit halfway. In this case, control unit 4 reflects this data on the selection of the reserve music.

Figure 8:
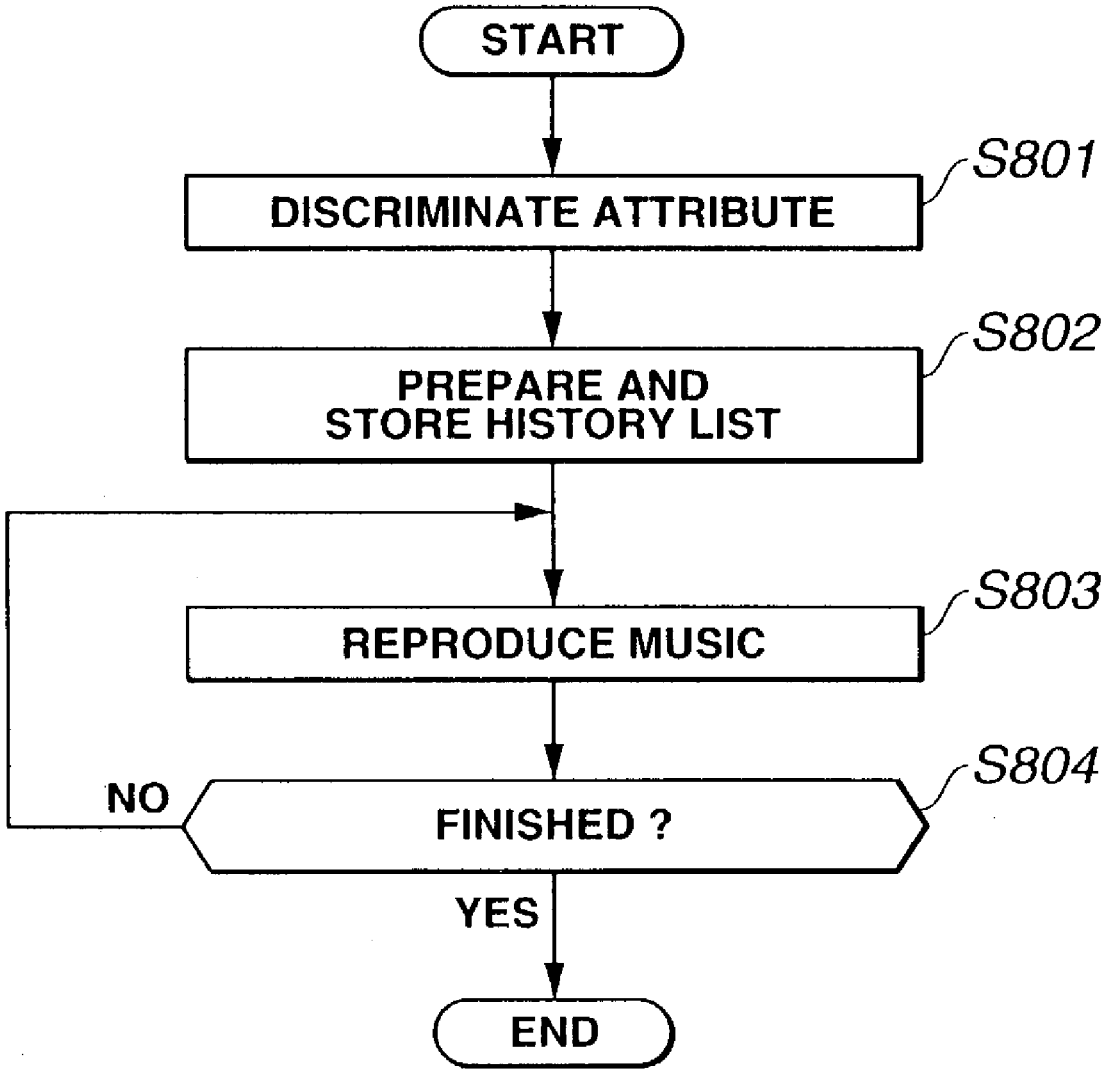
FIG. 8 is a flowchart showing a process for preparing a reproduction history in the system of FIG. 7.
Figure 9:
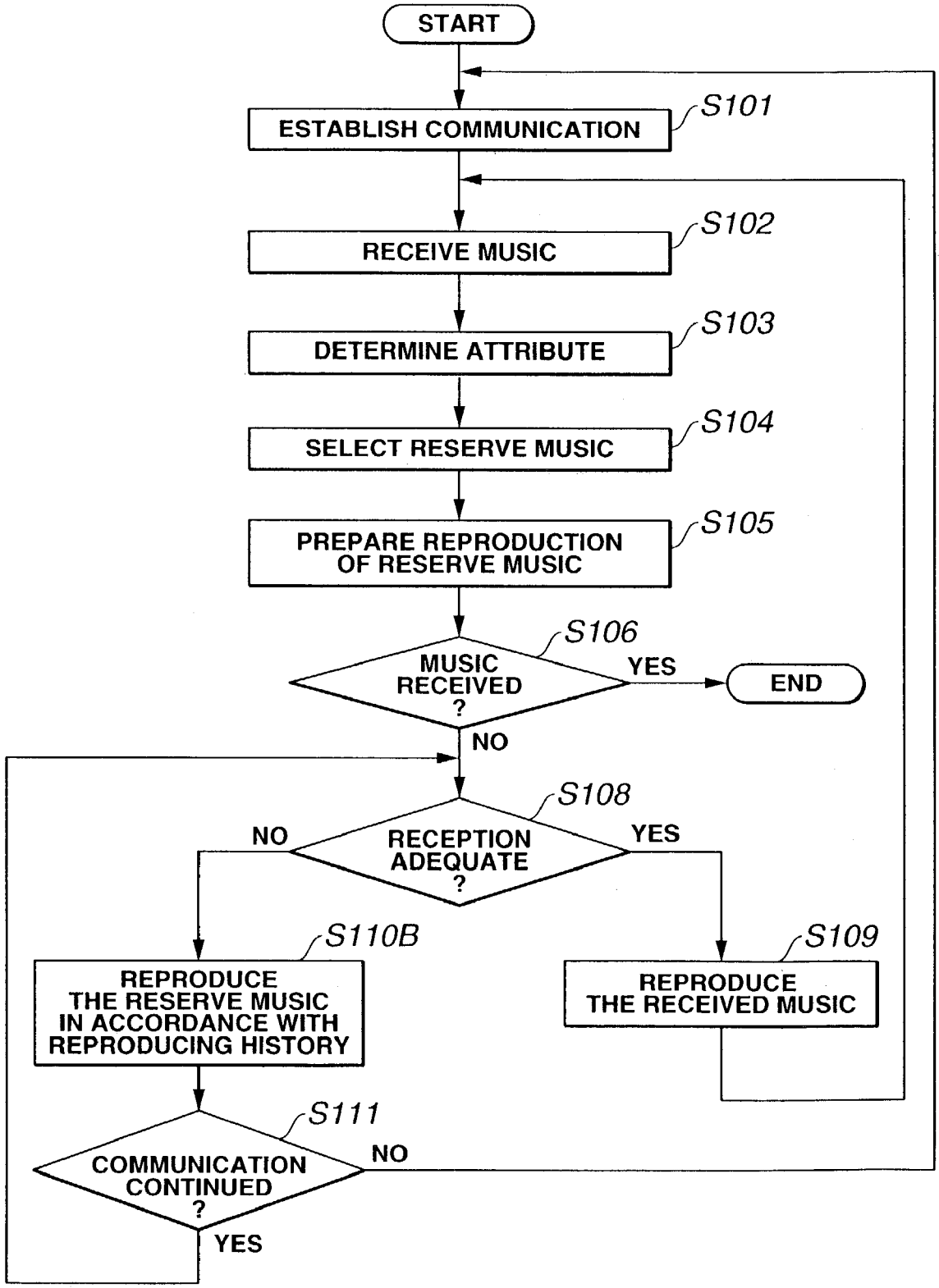
FIG. 9 is a flowchart showing a contents reproduction process performed by the system of FIG. 7.

FIGS. 8 and 9 show a contents reproduction process according to a fourth embodiment. FIG. 8 shows a process for preparing a reproduction history at the time of reproduction of music with the audio system. The program of FIG. 8 is started by use of the car audio system. At step S801, control unit 4 specifies music reproduced by the car audio system. In this example, control unit 4 determines the attribute of the music. At step S802, control unit 4 produce a reproduction history list in accordance with the result of attribution discrimination at step S801, and stores the reproduction history list in reproduction history storage section 410. At step S803, control unit 4 reproduces the music, and terminates the reproduction of the music when it is confirmed that the end of the music is reached at step S804.

FIG. 9 shows a contents reproduction process similar to the process of FIG. 2. Steps substantially identical to corresponding steps in FIG. 2 are given the same reference numerals, and repetitive explanation is omitted. When the reception state is not adequate, control unit 3 proceeds from step S108 to step S110B, and reproduces the reserve music selected in accordance with the reproduction history list prepared at step S802 of FIG. 8 and recorded in reproduction history storage section 410. Thus, this reproduction system selects and reproduces music of the highest reproduction frequency among music reproduced by the car audio system, by reading the selected music from music recording medium 105. In the fourth embodiment, the contents reproduction system may further include the attribute discriminating section 104 as shown in FIG. 1 or 3, or the combination of attribute discriminating section 104 and receiving history storage section 308 as shown in FIG. 5.

The contents reproduction system according to the fourth embodiment is arranged to preferentially select contents having the attribute frequently reproduced by the user with the car audio system. Therefore, music is selected more adequately in conformity with the taste of the user.

The present invention is not limited to these illustrated embodiments. The present invention is applicable to various systems for reproducing contents selected from contents preliminarily stored in a mobile unit when the output of received contents becomes unstable.

It is optional to apply each of the third and fourth embodiments to the second embodiment. In the illustrated embodiments, one or more of sections 101, 103 and 203 serves as means for receiving contents transmitted from a spatially separated place. One or more of sections 105 and 111 serve as means for storing contents to be reproduced. Section 102 or 202 serves as means for monitoring a receiving condition indicative of a reception state of data. Section 107, 207 or 407 serves as means for reproducing a received content or a stored or recorded content in dependence on the receiving condition. One or more of sections 104, 308 and 410 serve as means for examining at least one content selected by a user for reproduction, and determining a preference of the user. Section 106, 306 or 406 serves as means for selecting one content, as a reserve content, from the stored contents in accordance with the preference of the user, and for supplying the reserve content to the reproducing means when the receiving condition is in the unacceptable state.

This application is based on a prior Japanese Patent Application No. 2002-003804. The entire contents of the prior Japanese Patent Application No. 2002-003804 with a filing date of Jan. 10, 2002 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A contents reproduction system comprising:

a receiving section to receive contents transmitted from a spatially separated place;

a storage section to store contents to be reproduced;

a monitoring section to monitor a receiving condition indicative of a reception state of a content received by the receiving section;

a reproducing section to reproduce a received content received by the receiving section when the receiving condition is in a predetermined acceptable state, and to reproduce one of the contents stored in the storage section when the receiving condition is in an unacceptable state;

a preference discriminating section to examine at least one content selected by a user for reproduction, and determine a preference of the user; and a contents selecting section to select one, as a reserve content, from the contents stored in the storage section in accordance with the preference determined by the discriminating section, and to supply the reserve content to the reproducing section for reproduction instead of the received content when the receiving condition is in the unacceptable state;

wherein:

the preference discriminating section includes an attribute discriminating section to determine an attribute of a content received by the receiving section; and the contents selecting section is configured to select the reserve content from the contents stored in the storage section in accordance with the attribute determined by the attribute discriminating section.

2. The contents reproduction system as claimed in claim 1, wherein:

the reproducing section is configured to interrupt reproduction of the received content and to start reproduction of the reserve content instead of the received content when the receiving condition turns from the acceptable state to the unacceptable state; the selecting section is configured to select the reserve content during the reproduction of the received content and prepare for reproduction of the reserve content; and the storage section comprises a reading section to read a stored content and an attribute of the stored content from a recording medium.

3. The contents reproduction system as claimed in claim 1, wherein the preference discriminating section further comprises a receiving history recording section to record a history of reception of contents received by the receiving section; and the contents selecting section is configured to select the reserve content from the contents stored in the storage section in accordance with the history of reception so that a selected content has an attribute selected frequently by the user.

4. The contents reproduction system as claimed in claim 1, wherein the preference discriminating section comprises a reproduction history recording section to examine attributes of contents reproduced by the reproducing section and to determine a history of reproduction of contents; and the contents selecting section is configured to select the reserve content from the contents stored in the storage section in accordance with the history of reproduction so that the contents selecting section selects a content selected frequently by the user.

5. The contents reproduction system as claimed in claim 1, wherein the monitoring section comprises a reception monitoring section to monitor, as the receiving condition, a radio reception state of a content received by the receiving section.

6. The contents reproduction system as claimed in claim 1, wherein the contents reproduction system further comprises a temporary storage section to temporarily store a content received by the receiving section and supplying data of the content temporarily stored in the temporary storage section to the reproducing section for reproduction; the monitoring section comprises a temporary storage condition monitoring section to monitor, as the receiving condition, a storage quantity of data stored temporarily in the temporary storage section; and the reproducing section is connected with the temporary storage section and arranged to reproduce data temporarily stored in the temporary storage section when the storage quantity is greater than a predetermined threshold quantity level, and to reproduce the reserve content when the storage quantity is smaller than the predetermined quantity threshold level.

7. A contents reproduction system comprising:

means for receiving contents transmitted from a spatially separated place;

means for storing contents to be reproduced;

means for monitoring a receiving condition indicative of a reception state of data received by the receiving means;

means for reproducing a received content received by the receiving means when the receiving condition is in a predetermined acceptable state, and to reproduce one of contents stored in the storage means when the receiving condition is in an unacceptable state;

means for examining at least one content received by the receiving means, and determining an attribute of said at least one content; and means for selecting one content, as a reserve content, from the contents stored in the storing means in accordance with the attribute determined by the examining means, and for supplying the reserve content to the reproducing means for reproduction instead of the received content when the receiving condition is in the unacceptable state.

8. A contents reproduction process comprising:

receiving a received content transmitted from a spatially separated place;

determining an attribute of the received content;

selecting, as a reserve content, one from contents stored in a storage medium in accordance with the attribute of the received content;

examining whether a receiving condition indicative of a reception state of data of the received content is in a predetermined acceptable state; and reproducing the received content when the receiving condition is in the acceptable state, and reproducing the reserve content when the receiving condition is not in the acceptable state.

9. A contents reproduction system comprising:

a receiving section to receive contents transmitted from a spatially separated place;

a storage section to store contents to be reproduced;

a monitoring section to monitor a receiving condition indicative of a reception state of a content received by the receiving section;

a reproducing section to reproduce a received content received by the receiving section when the receiving condition is in a predetermined acceptable state, and to reproduce one of contents stored in the storage section when the receiving condition is in an unacceptable state;

an attribute discriminating section to determine an attribute of a content received by the receiving section; and a contents selecting section to select one, as a reserve content, from the contents stored in the storage section in accordance with the attribute determined by the attribute discriminating section, and to supply the reserve content to the reproducing section for reproduction instead of the received content when the receiving condition is in the unacceptable state.

10. The contents reproduction system as claimed in claim 1, wherein the receiving condition is strength of the signal received by the receiving section; the monitoring section is configured to examine the strength of the signal received by the receiving section; and the reproducing section is configured to reproduce the received content received by the receiving section when the strength of the signal received by the receiving section is higher than a threshold level, and to reproduce one of contents stored in the storage section when the strength of the signal received by the receiving section is lower than or equal to the threshold level.

11. A contents reproduction system for a vehicle, the contents reproduction system comprising:

an in-vehicle communication device to receive a signal transmitted from a spatially separated place in the form of electromagnetic waves;

an in-vehicle storage device to store a plurality of signals;

an in-vehicle output device converting electric signals to a perceptible form for reproduction; and an in-vehicle control unit to monitor a radio reception state of the signal received by the communication device;

to supply the signal received by the communication device to the output device when the ratio reception state is in a predetermined acceptable state, and to supply one of signals stored in the storage device to the output device, instead of the signal received by the communication device, when the reception state is in an unacceptable state;

to determine an attribute of a content of the signal received by the communication device, and thereby to estimate a preference of a user;

to select one of the signals stored in the storage device, as a selected signal, in accordance with the attribute of the content of the signal received by the communication device; and to supply the selected signal to the output device for reproduction instead of the signal received by the communication device when the reception state is in the unacceptable state.

12. A contents reproduction system for a vehicle, the contents reproduction system comprising:

an in-vehicle communication device to receive data transmitted from a spatially separated place in the form of electromagnetic waves;

an in-vehicle storage device to store a plurality of data sets;

an in-vehicle output device converting electric signals to a perceptible form for reproduction; and an in-vehicle control unit configured to store data received by the communication device temporarily in a temporary storage section for buffering;

to supply data temporarily stored in the temporary storage section to the output device for reproduction;

to monitor a temporary storage quantity of data stored in the temporary storage section; and to supply one of the data sets stored in the in-vehicle storage device, instead of the data stored in the temporary storage section, to the output device for reproduction when the temporary storage quantity decreases because of deterioration in reception of electromagnetic waves by the communication device.

* * * * *